United States Patent [19]

Wanner

[11] Patent Number: 4,776,406

[45] Date of Patent: Oct. 11, 1988

[54] MOTOR-DRIVEN HAND TOOL FOR DRILLING OR IMPACT DRILLING OPERATIONS

[75] Inventor: Karl Wanner, Leinfelden-Echterdingen, Fed. Rep. of Germany

[73] Assignee: Robert Bosch GmbH, Stuttgart, Fed. Rep. of Germany

[21] Appl. No.: 906,914

[22] Filed: Sep. 11, 1986

[30] Foreign Application Priority Data

Nov. 19, 1985 [DE] Fed. Rep. of Germany ..... 3540964

[51] Int. Cl.[4] ..... B25D 11/12; B25D 16/00

[52] U.S. Cl. ..... 173/18; 173/123; 173/170

[58] Field of Search ..... 173/12, 48, 123, 170, 173/46, 18; 310/103, 105, 106, 109

[56] References Cited

U.S. PATENT DOCUMENTS 2,479,986 8/1949 Thomas ..... 310/103

2,617,971 11/1952 Stack ..... 173/12

3,720,269 3/1973 Wanner et al. ..... 173/123

FOREIGN PATENT DOCUMENTS 2229388 1/1981 Fed. Rep. of Germany .

*Primary Examiner*—E. R. Kazenske

*Assistant Examiner*—Hien H. Phan

*Attorney, Agent, or Firm*—Michael J. Striker

[57] ABSTRACT

A motor-driven hand drill includes a housing, in which between a motor and a drill receptacle, a safety coupling for limiting a torque, applied to a drill, is positioned. For specific conditions, for example for drilling in armoring iron, the torque applied to the drill must be increased. The drill is provided with an electro-magnetic device which is operatively connected to the safety coupling to adjust the limiting torque applied to the drill. The magnetic device is actuated by means of a pushbutton positioned in the same gripping region as the pushbutton for actuating an electric motor of the drill to switch the same on and off.

7 Claims, 1 Drawing Sheet

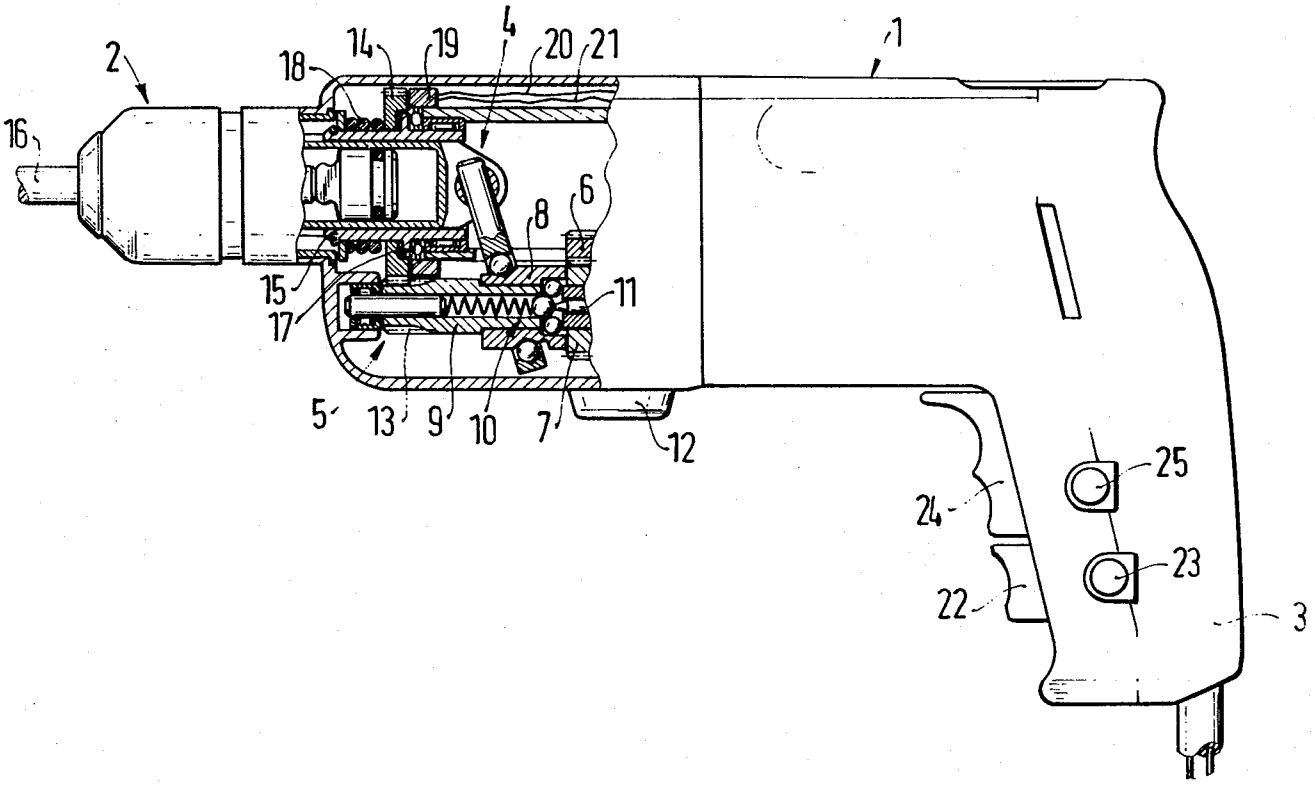
1
2
3
4
5
6
7
8
9
10
11
12
13
14
15
16
17
18
19
20
21
22
23
24
25

MOTOR-DRIVEN HAND TOOL FOR DRILLING OR IMPACT DRILLING OPERATIONS

BACKGROUND OF THE INVENTION

The present invention relates to a motor-driven hand tool for drilling or impact drilling workings.

Motor-driven hand tools of the foregoing type normally include a safety coupling which limits a translation torque and adjusts the limited torque applied to the drill by means of an additional handle. Such a hand tool has been disclosed, for example in DE-AS No. 22 29 388. The additional handle in this conventional hand tool is required for changing the translation torque as mentioned above. A one-hand drilling or impact drilling is impossible with such a tool. In addition to changing the translation torque with the additional handle, a feed motion transversely to the axis of the drill is required in the tool. The tool therefore has a non-desired transverse loading, and the position of the hand tool in the hands of an operator can be destabilized.

SUMMARY OF THE INVENTION

It is an object of the present invention to provide an improved motor-driven hand tool.

It is a further object of the invention to provide a motor-driven hand drill which is easy to handle and which can be utilized for one-hand manipulating, without non-typical loading of the drill.

These and other objects of the invention are attained by a motor-driven hand tool for drilling and impact drilling operations, comprising a safety coupling limiting a translation torque applied to a drill; an additional handle operatively connected to said safety coupling in which a limiting torque translated from the tool to the drill is adjustable; a handle having a gripping area; a first pushbutton positioned in said gripping area and actuated by an operator for switching on and off a motor of the tool; means for adjusting said limiting torque; and a second pushbutton for actuating said adjusting means, said second pushbutton being positioned in said gripping area.

The objects of this invention are also attained by a motor-driven hand tool for drilling and impact drilling operations comprising a safety coupling limiting a translation torque applied to a drill; an additional handle operatively connected to said safety coupling in which a limiting torque translated from the tool to the drill is adjustable; and an electromagnetically operated coupling for adjusting said limiting torque.

Due to the present invention the pushbutton for the adjusting device is located in the same gripping area as the pushbutton for an on-and-off switch for the motor of the tool, and a one-hand changing of the torque applied to the drill without producing forces transversely of the drill is possible.

Furthermore, due to the magnetically-increased engagement force of the torque coupling, no substantially enhanced actuation force is required. The position of the coupling within the housing of the tool remains independent from the position of the grip. This provides a compact structure in which only a very small idle space in the housing can be possible The above mentioned adjusting means may include an electromagnet to which voltage is applied by a switch means, and a spring, said electromagnet being positioned so that a magnetic force thereof increases the force of said spring, said safety coupling having a first portion and a second portion, wherein an increased force presses said first portion against said second portion and the torque is increased.

The second pushbutton may be continually urged by a spring force to a switch-off position, said second pushbutton being connected to a switch so that said switch, in a pressed-in position of said second pushbutton, is closed and, in a non-operative position of said second pushbutton, is opened.

The second pushbutton may be provided with a locking member which can lock said second pushbutton against being pressed-in.

Said locking member may be continually urged to a locking position for said second pushbutton by a spring force, said locking member having a further pushbutton which extends outwardly from a housing of the tool when said second pushbutton is locked and releases said second pushbutton when pressed-in. This is particularly advantageous because, upon release, the second pushbutton and the locking member automatically return to a non-operative position. Thus any undesired increase of the translation torque or retention of an increased torque are avoided by these means.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

The sole FIGURE of the drawing shows, partially in section, a hammer drill according to the invention.

DETAILED DESCRIPTION OF THE PREFERRED EMBODIMENT

Referring now to the drawing in greater detail, it will be seen that reference numeral 1 designates a housing of the hammer drill of this invention. The hammer drill includes a tool receptacle 2 and a hand grip 3. A striker 4 and a transmission unit 5 for a rotation motion are mounted in the housing 1. A motor pinion 6 drives, via a gear 7 and a sleeve 8 of a wobble plate transmission, a spindle 9. Thereby the drive for the sleeve 8 is selectively switchable on and off by means of a ball coupling 10. This ball coupling is actuated by bolts 11, the position of which is adjustable by operating a handle 12. The rotational movement of spindle 9 is imparted, via a pinion 13, to a gear 14 which is in mesh with that pinion. Gear 14 is positioned on a cylinder 15 concentrically with the tool receptacle 2. Cylinder 15 is a portion of the striker 4. This cylinder is adapted, in the conventional fashion, for a rotational engagement with a drill 16 held in the tool receptable 2. The rotational motion of gear 14 is translated to the cylinder 15 via a coupling 17. The latter is formed as a safety coupling limiting a torque being translated. The magnitude of the torque transmitted herein depends from the force, with which a helical spring 18 urges the gear 14 to a coupling position with the cylinder 15.

An electromagnet 19, which is stationarily supported in the housing 1, is positioned opposite to the end face of the gear 14, which faces away from the helical spring 18. Voltage is supplied to the electro-magnet 19, via electrical leads 20 and 21, by means of a switch which can be actuated by a pushbutton or key 22. Upon a selected arrangement of the electromagnet 19 relative to the gear 14, this electromagnet can increase the force, with which the gear 14 is pressed against the coupling 17. Thus the translation torque, generated by the helical spring 18, is substantially increased. In extreme cases, a rigid connection can be established between the gear 14 and cylinder 15.

A locking member corresponds to the pushbutton or key 22, which locking member can be displaced from the locking position relative to the pushbutton 22 by means of a pushbutton 23. The pushbutton 22 is also locked with a non-actuated pushbutton 23 against inadvertent pressing-in. The pushbutton 22 is positioned below a customary key or pushbutton 24 for the actuation of a switch for switching on and off the motor of the hand tool. Key 24 can be locked in its switch-in position by means of a pushbutton 25.

During the operation of the hammer drill according to the invention, the drill is firstly operated with a normal translation torque, the magnitude of which is defined by the compression of the helical spring 18. If now the drill 16, is for example applied to armoring iron, it can be clamped in a borehole. A higher engagement torque is required for drilling this armoring iron. An operator normally senses this situation and actuates firstly the pushbutton 23 and then the so-released pushbutton 22. The non-shown but conventional switch of any suitable type, actuated by the pushbutton 22, applies voltage to the electromagnet 19. A magnetic field produced by this electromagnet draws gear 14 with an increased force into a coupling engagement with the coupling 17. The engagement torque of this coupling is thus enhanced in a desired manner.

As soon as the pushbutton 22 is released, the current supply to the electromagnet is ceased, and an old translation torque defined by the helical spring 18, is utilized in the coupling 17.

It will be understood that each of the elements described above, or two or more together, may also find a useful application in other types of motor-driven hand tools for drilling operations differing from the types described above.

While the invention has been illustrated and described as embodied in a motor-driven hand tool for drilling operations, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prio art, fairly constitute essential characteristics of the generic or specific aspects of this invention.

What is claimed as new and desired to be protected by Letters Patent is set forth in the appended claims:

1. A motor-driven hand tool for drilling and impact-drilling operations, comprising a drive; a safety coupling operatively connected to said drive and translating a torque from said drive to a drill and limiting a translation torque applied to a drill; a hand grip having a gripping area; a first pushbutton positioned in said gripping area and actuated by an operator for switching on and off a motor of the tool; means for adjusting said torque and including an adjusting element which acts upon said safety coupling so as to increase said torque translated by said safety coupling; and a second pushbutton provided on said hand grip and operative for actuating said adjusting means so that by actuating of said adjusting element by said second pushbutton the adjusting element acts upon said safety coupling.

2. A motor-driven hand tool for drilling and impact-drilling operations, comprising a drive; a safety coupling (17) operatively connected to said drive and translating a torque from said drive to a drill and limiting a translation torque applied to a drill; a hand grip (3) having a gripping area; a first pushbutton (24) positioned in said gripping area and actuated by an operator for switching-on-and-off a motor of the tool; means (19) for adjusting said torque, said safety coupling and said adjusting means being formed so that said translated torque is increasable thereby; and a second pushbutton (22) for actuating said adjusting means, said second pushbutton being positioned in said gripping area.

3. The tool as defined in claim 2, wherein said adjusting means includes an electromagnet, and a spring (18) positioned at said coupling to exert on said coupling a force in a direction of coupling with said drive, said electromagnet being positioned at said coupling to exert on said coupling in said direction a magnetic force in addition to said force of said spring so that a total force acting on said coupling is increased whereby said translated torque is increased.

4. The tool as defined in claim 2, wherein said second pushbutton is continually urged by a spring force to a switch-off position, said second pushbutton being connected to a switch so that said switch, in a pressed-in position of said second pushbutton, is closed and, in a non-operative position of said second pushbutton, is opened.

5. The tool as defined in claim 4, wherein said second pushbutton is provided with a locking member (23) which can lock said second pushbutton against pressing-in.

6. The tool as defined in claim 5, wherein said locking member is continually urged to a locking position for said second pushbutton by a spring force, said locking member having a further pushbutton which extends outwardly from a housing of the tool when said second pushbutton is locked and releases said second pushbutton when pressed-in.

7. The tool as defined in claim 6, wherein said locking member is non-lockable automatically.

* * * * *